US007481297B1

(12) United States Patent
Leslie

(10) Patent No.: US 7,481,297 B1
(45) Date of Patent: Jan. 27, 2009

(54) APPARATUS AND METHOD FOR LUBRICATING RAILROAD TRACKS

(76) Inventor: Carlton Leslie, 4340 Cross St., Downers Grove, IL (US) 60151

( * ) Notice: Subject to any disclaimer, the term of this patent is extended or adjusted under 35 U.S.C. 154(b) by 581 days.

(21) Appl. No.: 11/021,448

(22) Filed: Dec. 23, 2004

(51) Int. Cl.
*B61D 3/00* (2006.01)

(52) U.S. Cl. ..... 184/3.1; 222/394; 184/3.2

(58) Field of Classification Search ..... 184/3.1, 184/2, 3.2; 222/54, 14, 394; 104/379; 105/96; 291/3, 11.2, 11.3, 22, 23, 25; 246/167 R, 246/168.8, 176, 415 R
See application file for complete search history.

(56) References Cited

U.S. PATENT DOCUMENTS

| | | | |
|---|---|---|---|
| 1,386,426 | A | 8/1921 | Riddle |
| 1,709,095 | A | 4/1929 | Protzeller |
| 2,285,082 | A | 6/1942 | Bolt |
| 2,718,280 | A | 9/1955 | Hurrell |
| 2,814,422 | A | 11/1957 | Mercier |
| 2,929,466 | A | 3/1960 | McWilliams |
| 3,051,262 | A | 8/1962 | Bettison |
| 3,059,724 | A | 10/1962 | Soule, Jr. |
| 4,214,647 | A | 7/1980 | Lutts |
| 4,245,719 | A | 1/1981 | Frank |
| 4,334,596 | A | 6/1982 | Lounsberry, Jr. |
| 4,346,785 | A | 8/1982 | Frank |
| 4,520,901 | A | 6/1985 | Borup et al. |
| 4,711,320 | A | 12/1987 | Dombroski et al. |
| 4,726,448 | A | 2/1988 | Schroeder et al. |
| 4,930,600 | A | 6/1990 | Kumar et al. |
| 5,129,606 | A | 7/1992 | Rodems et al. |
| 5,186,280 | A | 2/1993 | Mattcheck |
| 5,477,941 | A | 12/1995 | Kumar et al. |
| 5,492,642 | A | 2/1996 | Mulvihill et al. |
| 5,842,543 | A | 12/1998 | Naito et al. |
| 5,896,947 | A | 4/1999 | Kumar |
| 6,076,637 | A | 6/2000 | Kumar |
| 6,170,610 | B1 | 1/2001 | Kumar |
| 6,199,661 | B1 | 3/2001 | Kumar |
| 6,446,754 | B1 | 9/2002 | Kostelny-Vogts et al. |
| 2003/0111295 | A1 | 6/2003 | Kumar et al. |

*Primary Examiner*—Robert A Siconolfi
*Assistant Examiner*—James K Hsiao
(74) *Attorney, Agent, or Firm*—C. John Brannon; Brannon & Associates PC

(57) ABSTRACT

The tracks of a railroad yard system have an access track and a plurality of switches leading to a plurality of yard tracks are lubricated by a lubricating station positioned on the access track. In addition to lubricating the tracks, lubrication nozzles are directed at the switch plates and switch points of the switches of the system. Detectors are positioned on the yard tracks to determine the speed of the cars as they roll down track and into the yard, and a computer, responsive to these detectors, control the discharge of lubricant by the lubricating station. Detectors are also positioned near each switch plate to detect when each switch plate moves, and a dispensing system dispense lubricant through the nozzle directed toward a switch plate whenever the switch plate is moved.

17 Claims, 3 Drawing Sheets

APPARATUS AND METHOD FOR LUBRICATING RAILROAD TRACKS

CROSS-REFERENCE TO RELATED APPLICATIONS

The present application is a utility application claiming priority to, and based upon, copending U.S. patent application Ser. No. 10/238,451, filed Sep. 10, 2002 and claiming priority to then-copending U.S. patent application Ser. No. 09/633,390, filed Aug. 7, 2000.

TECHNICAL FIELD OF THE INVENTION

The present invention relates to the lubrication of railroad tracks and, in particular, to an improved method of controlling the amount of lubricant applied to the tracks of a switch yard.

BACKGROUND OF THE INVENTION

It is well known that the application of a lubricant to the surfaces of railroad tracks improve the rollability of railroad cars thereby significantly reducing the rate at which the tracks become worn by the wheels of the cars which move along them. Lubricating the tracks also reduces the wear to the wheels of the cars. Curves and switches are particularly subject to wear.

The cars of a train are disassembled and reassembled into new trains in a yard which has numerous parallel tracks that are accessible from the opposing ends thereof by access tracks connected by switches. The track, including curves and switches, are currently lubricated by injecting a lubricant through outlets on to the surface of the tracks.

Within the yard the cars of an incoming train are disassembled and recombined with cars from other incoming trains into a plurality of new outgoing trains, with the cars of each new train lined up on a separate track in the yard. One method is a hump yard for such purposes, where a switch engine moves a car over a hump at a speed of approximately three miles per hour. The cars are independently released on the crest of the hump and allowed to roll down the far side of the hump and across switches to tracks on which the new trains are being formed.

In a hump yard, the speed of the car as it moves along the track system is controlled by a series of retarders. A computer associated with each retarder receives information regarding the weight of the incoming car and has a sensor for determining the speed at which the car is entering the retarder. It also maintains a count of the number of cars being directed to each yard track and adjusts the application of the retarder based on the incoming speed, the wright of the approaching car and the space remaining on the yard track. Other sensors in the system follow the car's progress across the switches of this system and prohibit the premature throwing a switch along the path of a rolling railroad car. Except for weight, the retarders of a hump yard system are not responsive to the condition of an individual car or to the condition of the track.

The dispensers now being used to lubricate the tracks of a yard system have an associated detector for detecting that a car is approaching and the dispenser dispenses a fixed amount of lubricant each time a car passes. When the tracks are properly lubricated, a railroad car that does not have its brake applied and is free of defects will move along the tracks of the system at a predictable rate. In reality, however, several factors affect the amount of lubricant needed to maintain the optimum rollability of cars over the tracks. Over lubrication will cause excess lubricant to build up in the yard tracks.

Excess lubricant is a hazard to railroad personnel, can cause roll out, can cause damage to the cars and the contents thereof, and contaminates the underlying ground.

Water is a natural lubricant and, therefore, a lesser amount of lubricant is needed on the tracks during rain or snow. On the other hand, rain or snow will wash some of the lubricant off the tracks leaving the tracks in need of restoration of the desired level of lubrication after the rain has ended. Cars moving along the tracks of an adequately lubricated yard system will lose speed at a predictable rate thereby allowing the orderly assembly of the cars on the yard tracks. On the other hand, the cars move more slowly along inadequately lubricated tracks, as occurs following a rain storm.

Lubricant which is dispensed on the track is picked up by the wheels of a moving railroad car and spread down the track. Once a few cars have applied lubricant to a previously under lubricated track, the cars will again begin moving at their desired speeds, after which only intermittent application of lubricant are needed to maintain adequate lubrication. It is unnecessary, therefore to apply lubricant to the tracks each time a car is released over a hump as currently done in a hump yard.

All of the foregoing problems could be reduced or eliminated by providing a means of measuring the need for lubricant on the tracks of a yard system and controlling the application of lubricant in response to the measured need. Until the present invention, the railroad industry has not had such a means for measuring the need for lubricant on the tracks of a yard system.

SUMMARY OF THE INVENTION

Briefly, the present invention is embodied in a method of controlling the application of lubricant to the tracks of yard rail systems of the type having an access track leading to a plurality of switches and then into a second plurality of yard tracks into which moving railway cars can be directed. In accordance with the invention, a primary lubricating station is provided immediately following the primary retarders. Where the yard has a hump, the primary retarder is positioned immediately after the hump. A speed detector detects the presence and the speed of a railroad car approaching the primary lubricating station. Secondary lubricating stations may be provided down track to lubricate the yard tracks as needed. Each lubricating station has a reservoir of lubricant, a positive displacement pump, and a plurality of nozzles arranged to apply lubricant along a portion of rail having a length approximately equal to the circumference of a wheel of a railroad car. Positioned down track, along each of the yard tracks of the system, are detectors for detecting when a rail car has passed.

A logic, which may be a computer, receives input from the speed detector and the down track detectors and calculates the speed of the car as it moves through the tracks by dividing the length of track between the primary lubricating station and the down track detector by the time needed to pass between the two points. The calculated average speed of the car is then compared to a predetermined desired speed retained in the memory of the computer. The difference between the desired speed and the actual car speed is used by the logic to control the rate at which lubricant is applied to the tracks. When the logic determines that cars are losing speed more rapidly than desired, the logic will cause the pump and the nozzles to dispense lubricant immediately before the next railroad car reaches the station. On the other hand, were the logic to determine that the speed of cars down track equals the desired speed, the amount of lubricant being dispensed on the tracks will be reduced or terminated.

Occasionally a car will move along the tracks of a system at an excessively high rate of speed or at an exceptionally low rate of speed. A car will move at an excessively high rate if the retarder does not function properly or has failed altogether. A car will move at an exceptionally slow rate of speed if the brake on the car is being applied or if the car is defective in some manor. In accordance with the invention excessive speeds or exceptionally low speeds are detected by a speed detector located before the primary lubrication station. When the logic determines that the initial speed of the car does not fall within expected parameters the system will not apply lubricant to the tracks ahead of the car and the speed of the car will be ignored for determining the need for further lubrication of the tracks. Also, the system will identify an exceptionally slow moving car so that the car can be checked before it leaves the yard. It is far more expensive to deal with a defective car on the open track than in a yard where repairs can easily be made.

BRIEF DESCRIPTION OF THE DRAWINGS

A better and far more complete understanding of the current invention will be had following reading the following detailed descriptions taken in conjunction with the drawings wherein.

DETAILED DESCRIPTION OF THE PREFERRED EMBODIMENT

Figure 1:
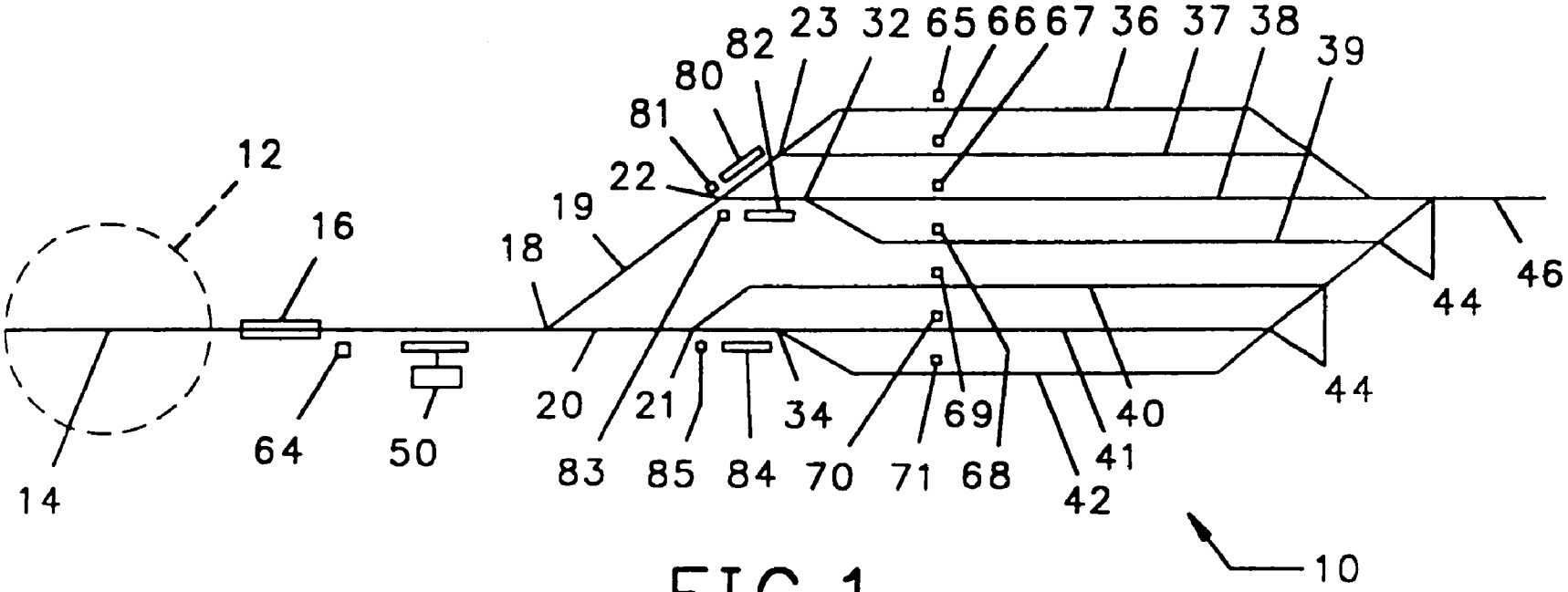
FIG. 1 is a schematic view of the tracks of a yard rail system.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Referring to FIG. 1, a typical yard track system 10 has a hump 12, across which is a feeder track 14. Feeder track 14 passes a first retarder 16 after which there is a first switch 18 for dividing the track 14 into two tracks 19, 20. Following the first switch 18 are secondary switches 21, 22, 23, and following the secondary switches 21, 22, 23 are secondary retarders, now shown. Following the secondary retarders are further switches 32, 34 which ultimately breaks the lines down to yard tracks 36, 37, 38, 39, 40, 41, 42. At the far end of the yard is a second plurality of switches 44 leading to an exit lead 46 across which the assembled trains are withdrawn. An incoming train is broken up by releasing cars over the hump 12 and allowing them to roll down the feeder track 14 and into the yard tracks 36-42.

The retarder 16 has a computer (not shown) that receives input from a speed detector (not shown) and from a scale (not shown) that categorizes the weight of the car. Using these two pieces of information and a look-up table stored in its memory, the computer adjusts the resistant force applied by the retarder 16 to the wheels of the car. If a railroad car is not defective, the car will be moving at the optimum speed when it leaves the retarder and it will move at a predictable speed down track to its destination provided the track has been properly lubricated. On the other hand, if the car is defective, such as because the brake is being applied when it shouldn't be applied, because the bearings of the wheels are worn, or the like, the car will leave the retarder at a significantly slower speed than the optimum speed and its progress as it moves through the yard will be noticeably below the predicted speeds.

It should also be appreciated that a defective car (i.e. a car having the brake applied when it shouldn't be applied, having worn wheel bearings or the like) will leave the retarder at a significantly slower speed than the optimum speed and the noticeably slow moving car can be detected and identified by the first sensor 64. A defective car will also move through the system at a noticeably slower rate of speed. Defective cars are therefore identifiable by their reduced speed after leaving the retarder.

When an entire train is assembled on a yard track, the switches 44 at the output end of the bowl are reconfigured to withdraw the assembled train out the exit lead 46.

Referring to FIGS. 1 through 4, in accordance with the present invention, located behind the first retarder 16 on the feeder track 14 is a lubricating station 50. The lubricating station 50 has a supply tank 52, a pump assembly 54 for ejecting the lubricant in the supply tank 52, a motor 56 for operating the pump assembly 54, and a network of feeder lines 58 for directing lubricant to a plurality of nozzles 60. A electronic controller or microprocessor 62 controls the operation of the motor 56 and thereby regulates the discharging of lubricant through the nozzles 60. The microprocessor 62 receives input from a first sensor 64 which detects the speed of a car approaching the lubricating station 50 and from a plurality of secondary detectors 65, 66, 67, 68, 69, 70, 71, each of which is positioned on one of the yard tracks 36, 37, 38, 39, 40, 41, 42 respectively.

Figure 2:
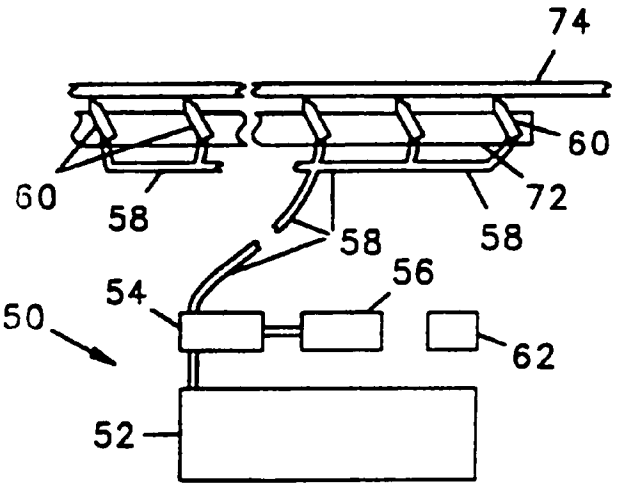
FIG. 2 is a top view of the nozzles of a dispensing system for dispensing lubricant positioned on a track in the yard system shown in FIG. 1.
Figure 3:
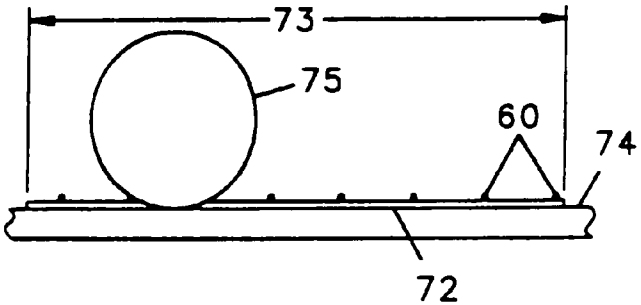
FIG. 3 is a schematic side view of the nozzles and dispensing system shown in FIG. 2 with the wheel of a railroad car rolling thereon.

Referring further to FIGS. 2 and 3, in accordance with another feature of the invention, the dispensing system includes two mounting bars 72, one positioned along the inner surface of each of the rails of a track 74. Positioned along the length of each of the mounting bar 72 are the nozzles 60 which are of a type known in the art for dispensing lubricants. Each mounting bar 72 has a length 73 which is approximately equal to the circumference of a typical rail car wheel 75 so that lubricant dispensed through the nozzle 60 on the mounting bar 72 will lubricate the entire circumference of the wheel 75 as it rolls across the lubricated portion of track 74. The wheels of the railroad car will then transport the lubricant down the feeder track 14 to the selected yard track into which the car is directed.

The invention requires that the nozzles 60 be positioned sufficiently close to one another and that the pump assembly 54 eject an adequate amount of lubricant on each application to apply a continuous path of lubricant along the entire length 73 of the track 74. It should be noted that the viscosity and other properties of the lubricant change with temperature; thus, the amount of lubricant being applied by the nozzles may be temperature dependent in some pump systems. Thus, the pump assembly 54 should be adapted to supply a constant amount of lubricant independent if the temperature of the lubricant, pump assembly 54 and/or tracks such that the desired amount of lubricant will be ejected through the nozzles 60 on each application. One type of pump assembly 54 adequate for the job is a positive displacement pump. Another type of pump assembly 54 adequate for the job is a pressurized lubricant reservoir connected to the nozzles 60 via solenoid switches (not shown) wherein the switches are controlled by the microprocessor 62.

It is desirable that the lubricant be evenly applied along the length 73 of the track 74, however, the nozzles 60 of a dispensing system can become damaged from debris carried by the moving cars or the like. Damaged nozzles may partially restrict the flow of lubricant passing therethrough, and if they are all linked together they may not dispense the lubricant evenly on the track. To insure that the lubricant is evenly applied along the length 73 of the mounting bar 72, each nozzle 60 has an associated valve 76. The valves 76 are sequenced, such that each valve 76 is successively independently opened. All the lubricant dispensed by the pump assembly 54 will then pass through only one nozzle at a time thereby insuring that the nozzle 60 all dispense an equal amount of lubricant.

Figure 4:
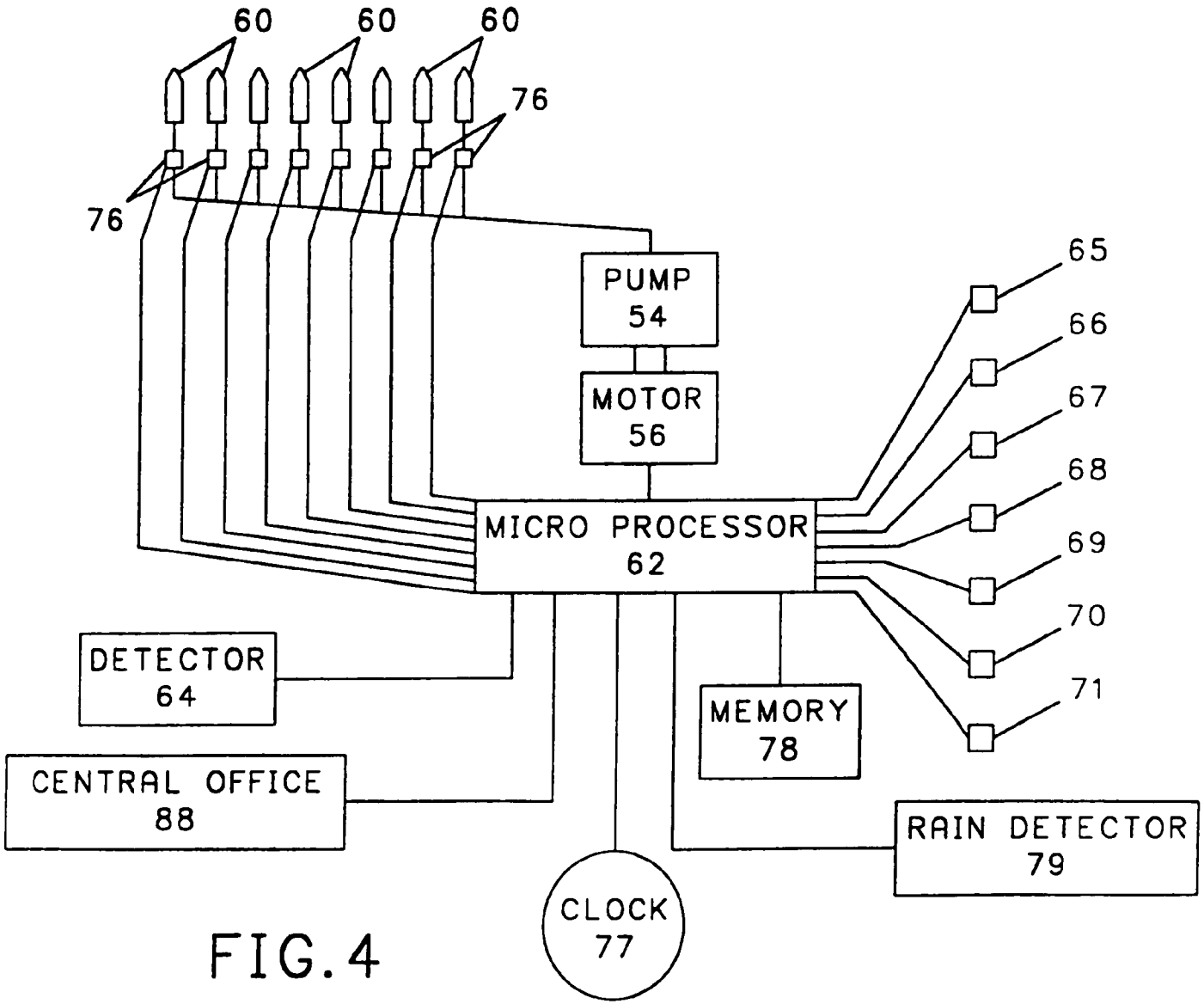
FIG. 4 is a schematic diagram of the feedback system for controlling the dispensing of lubricant through the nozzles shown in FIG. 2.

Referring further to FIGS. 1 and 4 as a moving railroad car reaches the associated yard track 36, 37, 38, 39, 40, 41, 42, it will pass over the associated detector 65, 66, 67, 68, 69, 70, 71, which will send a signal to the microprocessor 62 designating the arrival time of the car. The microprocessor 62 includes a clock 77 and a memory 78, and the microprocessor 62 will divide the time that has elapsed from when the car crossed the first detector 64 to when it arrived at the secondary detector by the distance traveled to calculate an average speed for the car. If the average speed of a car entering a yard track 36-42 is below a predetermined desired speed stored in the memory 78 of the microprocessor but not excessively slow, the microprocessor 62 will direct power to the motor 56 for operating the pump assembly 54 and apply lubricant to the track when the wheels 75 of the next railroad car approaches the station 50. If the microprocessor 62 determines that the cars are rolling at the desired speed, it will not direct power to the motor 56 when the next railroad car approaches thereby controlling the further lubrication of the tracks.

The microprocessor 62 is also responsive to a rain detector 79 which detects when the tracks in the system are being lubricated by rain or snow. It is not necessary to lubricate wet tracks because water is an adequate lubricant. Accordingly the computer 62 is programmed to ignore readings from the detectors while the rain detector indicates the tracks are wet. The rain may, however, wash lubricant off the tracks, and therefore the computer 62 will initiate new calculations to determine track lubrication as soon as the tracks dry. The microprocessor 62 will therefore energize the motor 56 on information detected after the tracks have dried that show that cars are moving below the desired speeds. The microprocessor will also detect the presence of a potentially defective railroad car and notify the central office 88 as is further described below.

Referring to FIG. 1, the invention further includes secondary lubrication stations 80, 82, 84 positioned after switches 18, 21, and 22 and prior to switches 23, 32, and 34. Each of the secondary lubrication stations 80, 82, 84 has a supply tank, a motor, a pump assembly, nozzles and a microprocessor (all not shown) as described with respect to the primary lubrication station 50, and has a detector 81, 83, 85 respectively, associated therewith. Like the first detector 64 of the primary station 50, the detectors 81, 83, 85 of the secondary stations 80, 82, 84 are positioned immediately before the associated secondary station and signal the station when a railroad car is approaching. Each secondary lubrication station 80, 82, 84 receives additional input only from the detectors which are located down track of the station. That is, station 80 receives input only from detectors 65, 66, station 82 receives input only from detectors 67, 68, and station 84 receives input only from detectors 70, 71.

The secondary stations 80, 82, 84 provide lubrication to only a portion of the track system 10 and not to the entire system as does the primary station 50, and are activated only after the computer 62 of the primary lubricating station 50 determines that the access tracks are already adequately lubricated. For example, if a number of cars have been directed down tracks 14 and 19 to yard tracks 65 and 66, the entire length of this portion of the system will have become lubricated as a result of the lubricant dispensed from the primary station 50. The cars directed to yard tracks 65 and 66 would then be rolling at the desired average speed and the station 50 would not be applying lubricant to the racks. If cars are subsequently directed to yard tracks 67 and 68, and these cars are found to have an average speed less than the desired speed, the loss in speed would presumably be due to inadequate lubrication of yard tracks 67 and 68. In this event the microprocessor 62 of the primary station 50 will not direct power to the motor 56 to further lubricate the tracks. The microprocessor of the secondary station 82, however, will measure the time required for a car to pass from the detector 83 associated with the station 82 to the down track detectors 67 and 68. If this microprocessor determines that these cars are not moving at the desired speed, it will direct power to the associated motor and the secondary station 82 will commence lubricating the tracks prior to the passing of each railroad car. The secondary station will continue to dispense lubricant to the tracks until the cars are again rolling at the desired speed, after which the secondary station 82 will stop lubricating the tracks prior to the passage of a railroad car.

As can be seen, the present invention provides feedback from down track of the speed of the railroad car. Where the speed of the car is below a predetermined speed, the lubricating stations 50, 80, 82, 84 will dispense lubricant on the track 74 immediately before the arrival of the next railroad car. The rolling cars will pick up the lubricant on the wheels thereof and apply it to the track as they move. The system will continue to dispense a fixed amount of lubricant on the tracks prior to the passing of a railroad car until the microprocessors 62 of the various stations determine that the cars are rolling at speeds consistent with lubricated tracks, after which the microprocessors 62 will terminate the dispensing of lubricant.

Referring to FIG. 4, a feature of the present invention is that it will identify potentially defective cars. It is far more expensive to deal with a defective car after it has been incorporated into a moving train than to repair the car while it is still in a yard.

When the microprocessor determines that a car passing the detector 64 is moving at either an excessively high speed or an exceptionally slow speed, the microprocessor 62 of the various stations 50, 80, 82, 84 will identify the car as defective and will not energize the associated motor 56 to eject lubricant on the tracks in the path of the car. The microprocessor 62 will also ignore all information from the various sensors triggered by the car in determining whether lubrication is needed for succeeding cars thereby avoiding erroneous information into its calculations. Finally, the microprocessor will notify the central office 88 of an exceptionally slowly moving car which may be defective.

Figure 5:
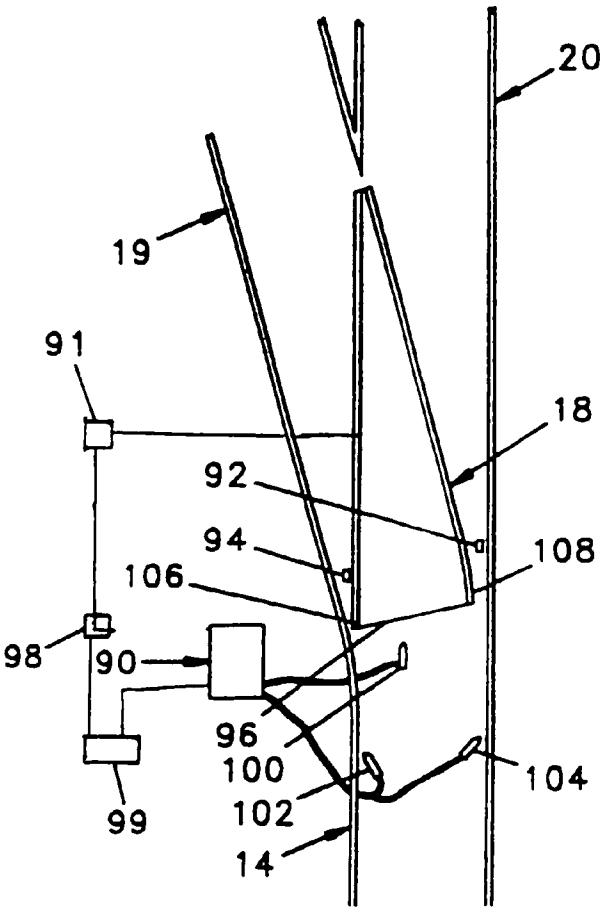
FIG. 5 is a schematic view of a lubricating system for the switch plate of a switch.

Referring to FIG. 5, the invention further includes a lubrication station 90 positioned at each switch 18, 21, 22, 23, 32, 34 of which switch 18 is exemplary of all such switches. The switch plates and the switch points of a railroad system are especially subject to wear, but currently, no effort is made to apply lubricant to these portions of existing yard systems. There is also a need to lubricate the switches that are not part of a yard system.

The lubrication station 90 includes a reservoir, a positive displacement pump, a motor and a microprocessor (none of which are shown) similar to those discussed with respect to primary lubricating station 50. The lubrication station 90 also has first and second detectors 92, 94 for detecting whether the switch plate 96 of the switch 18 is locked to direct a moving car down track 19, or is locked to direct a moving car down track 20. Station 90 also has a primary lubricating nozzle 100 aimed to direct lubricant onto the switch plate 96 and secondary nozzles 102 and 104 to direct lubricant to the tops of the rails a short distance before the switch points 106, 108.

Preferably the secondary nozzles are positioned to direct a flow of lubricant at a point on top of the track that precedes the switch point by a distance approximately equal to the circumference of the wheel of a railroad car. When lubricant is dispensed to the top of a track, the lubricant will be picked up on the wheels of the next passing railroad car. Where the lubricating point precedes the switch point by approximately the circumference of a wheel, the wheels of the next passing railroad car will go through one revolution after when they will transfer some of the lubricant thereon to the surface of the switch point thereby lubricating the switch point.

A logic device, which may be a microcomputer, initiates the operation of the pump to direct lubricant from the reservoir to the nozzles 100, 102, 104 when the detectors 92, 94 detect that there is movement of the switch plate 96. The lubrication station 90 will, therefore, lubricate the switch plate 96 and the switch points 106, 108 of switch 98 each time the switch is thrown.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed:

1. A method of lubricating the switch plate of a railroad switch where said switch plate is moveable between a first position in which said switch will direct a rolling railway car to a first track and a second position in which said switch will direct a rolling railway car to a second track, said method comprising the steps of:

connecting to said switch plate a first detector for generating a signal in response to said switch plate being moved to said first position, filling a reservoir of lubricant, connecting a pump and a nozzle for dispensing said lubricant from said reservoir, positioning said nozzle to direct a flow of lubricant to said switch plate; and actuating said pump dispense lubricant through said nozzle in response to said signal from said detector.

2. The method claim 1 and further comprising the steps of:

connecting to said switch plate a second detector for generating a signal in response to said switch plate being moved to said second position; and actuating said pump in response to said signal from said first detector and said signal from said second detector.

3. A method of lubricating the switch plate of a railroad switch where said switch plate is moveable between a first position in which said switch will direct a rolling railway car to a first track and a second position in which said switch will direct a rolling railway car to a second track, said switch being operating by an electric motor, said method comprising the steps of:

generating a first signal in response to the amount of power drawn by said electric motor, recording a maximum power draw from said electric motor, comparing the amount of power drawn by said electric motor the recorded maximum power draw, generating a second signal when said power drawn by said electric motor exceeds said recorded maximum power draw; and dispensing lubricant in response to said second signal.

4. The method of claim 3 wherein said switch has a switch point, said method comprising the further steps of:

lubricating said switch point in response to said second signal.

5. The method of claim 3 and comprising the further step of notifying a central office in the event the amount of power drawn by said motor as shown by said means for generating exceeds said maximum power drawn in said memory each time said motor is activated for a given number of successive activations.

6. The method of claim 3 wherein the first signal is generated by an ammeter.

7. The method of claim 3 wherein the first signal is generated in response to a change in an electric field.

8. A method of lubricating the switch point of a railroad switch where said switch point is moveable between a first position in which said railroad switch will direct a rolling railway car to a first track and a second position in which said railroad switch will direct a rolling railway car to a second track, said railroad switch preceded by a length of railroad track equal to about the circumference of a wheel of a railroad car, said method comprising of:

filling a reservoir with lubricant, connecting a pump and a lubricant dispenser for dispensing said lubricant from said reservoir, directing a flow of lubricant onto said length of track preceding said switch point, beginning at a point that precedes said switch plate by about one revolution of a wheel of a railroad car, and actuating said pump to dispense lubricant through said lubricant dispenser in response to a signal.

9. The method claim 8 and further including the steps of:

connecting a signal generator for generating a signal in response to said switch point being moved to said first position.

10. The method of claim 8 including the step of directing said lubricant dispenser to direct a flow of lubricant to the top of said track.

11. A method of lubricating a length of a railroad track comprising the steps of:

the steps of spacing a plurality of nozzles, spacing said nozzles along said length of track, directing said nozzles to dispense lubricant to a surface of said length of track, providing a reservoir of lubricant and a pump for pumping said lubricant, providing a piping means for piping said lubricant to said plurality of nozzles, providing valves means along said piping means for controlling the flow of lubricant to said plurality of nozzles, and providing sequencing means for controlling said valve means wherein said flow of lubricant is directed to one of said plurality of nozzles at a time.

12. A method of identifying as potentially defective a railroad car as it moves along a length of railroad track of a switch yard comprising the steps of:

providing means for lubricating said length of railroad track, providing means for controlling the initial speed of a railroad car that is firected along said length of railroad track, directing said car along said length of railroad track at a predetermined initial speed, providing means for calculating an average speed of said railroad car as it moves along said length of railroad track, providing a computer including a memory, storing in said memory a look up chart of expected average speeds over said length of track for railroad cars moving on lubricated tracks at various initial speeds, calculating an average speed of said car as it moves across said length of track, comparing said calculated average speed to said expected average speed from said look up chart, and if said calculated average speed of said railroad car is less than said expected average speed, identifying said car as potentially defective in order that it may be inspected.

13. The method of claim 12 and comprising the further step of notifying the central office of a defective car.

14. The method of claim 12 wherein said means for controlling the initial speed of a railroad car comprises a retarder.

15. A method of lubricating a length of railroad track comprising the steps of:

positioning along said length of railroad track a detector for detecting a measurable characteristics of a railroad car moving along said length of railroad track, wherein said measurable characteristics is useable to determine whether said length of railroad tracks is lubricated, storing in memory a look up chart of said characteristics for a railroad car moving along said length of railroad tracks while said railroad tracks are lubricated, detecting when said railroad tracks are not moist, comparing measured characteristics of a moving railroad car to characteristics in said look up chart as a measure of track lubricating only while said railroad tracks are not moist; and automatically lubricating said length of track when said measured characteristics of a moving railroad car do not match the characteristics in said look up chart.

16. The method of claim 15 wherein an average speed of a railroad car is the measurable characteristics indicative of lubricated railroad tracks.

17. A method of identifying as potentially defective a railroad car as it moves along a length of railroad track comprising the steps of:

providing means for lubricating said length of railroad track, providing a retarder for controlling the initial speed of a railroad car that are directed along said length of railroad track, directing said car along said length of railroad track, using said retarder to apply a predetermined amount of resistance to said moving car to reduce the speed of said car to an optimum initial speed, providing means for determining the speed of said car, providing said means for determining speed after said retarder, storing in said memory a look up chart of expected initial speeds for railroad cars leaving said retarder in response to the operation of said retarder, using said means for determining speed to find a speed of said car, comparing said determined speed to said expected initial speed from said look up chart, and if said determined speed of said railroad car is less than said expected initial speed, identifying said car as potentially defective in order that it may be inspected.

* * * * *